US005460308A

United States Patent [19]

Hahn

[11] Patent Number: 5,460,308

[45] Date of Patent: Oct. 24, 1995

[54] ARTICLE CARRYING STRAP

[76] Inventor: Linda G. Hahn, R.D. 2 Box 1595, Claremont Dr., Seven Valleys, Pa. 17360

[21] Appl. No.: 160,202

[22] Filed: Dec. 2, 1993

[51] Int. Cl.[6] ..... A45F 3/14

[52] U.S. Cl. ..... 224/257; 224/258; 224/901; 224/250

[58] Field of Search ..... 224/257, 258, 224/901, 250, 264, 151, 150; 24/442, 306

[56] References Cited

U.S. PATENT DOCUMENTS

| | | | |
|---|---|---|---|
| 2,884,173 | 4/1959 | Campbell et al. . | |
| 3,275,205 | 9/1966 | Howd et al. . | |
| 3,841,542 | 10/1974 | Hogensen, Jr. . | |
| 3,920,166 | 11/1975 | Hogensen, Jr. . | |
| 3,947,927 | 4/1976 | Rosenthal | 128/DIG. 15 |
| 4,311,263 | 1/1982 | Bianchi | 224/150 |
| 4,863,083 | 9/1989 | Chen . | |
| 4,939,818 | 7/1990 | Hahn | 24/442 |
| 4,982,885 | 1/1991 | Severson et al. . | |
| 5,014,890 | 5/1991 | Perry | 224/901 |
| 5,044,538 | 9/1991 | Bader . | |
| 5,048,158 | 9/1991 | Koerner | 24/442 |
| 5,110,023 | 5/1992 | Colin . | |
| 5,143,266 | 9/1992 | Heckerman et al. | 224/264 |
| 5,165,584 | 11/1992 | Meagher et al. | 224/258 |
| 5,168,603 | 12/1992 | Reed | 24/306 |

*Primary Examiner*—Henry J. Recla
*Assistant Examiner*—David J. Walczak
*Attorney, Agent, or Firm*—Richard C. Litman

[57] ABSTRACT

A carrying strap for toting articles of clothing, including a first end for forming a shoulder strap, and a second end for forming a toting strap for carrying the article. The first end and the second end include the hook fastening element of a hook and loop fastening system. The loop fastening element is set along the center region of the strap. Both elements of the hook and loop system are set on the same side of the strap. A slit is formed in the strap between the second end and the center loop fastening element. The second end is passed through the slit and fastened to the center fastening element. The first end is fastened to the opposite end of the center fastening element to form the shoulder strap. The carrying strap is convertible into a scarf by folding both ends over and fastening the hook element of both ends of the strap to the loop element along the center region of the strap.

12 Claims, 2 Drawing Sheets

ARTICLE CARRYING STRAP

BACKGROUND OF THE INVENTION

1. Field of the Invention

The present invention relates to a carrying strap for clothing and other articles, and in particular where a user may carry such articles over one's shoulder.

2. Description of the Prior Art

Carrying straps for various articles such as hoses, athletic equipment or baggage frequently include one end for embracing a shoulder and another end for carrying the object.

U.S. Pat. No. 5,110,023, issued to George M. Colin on May 5, 1922, describes a double loop sling for carrying heavy hoses. The two ends of a strap are attached to one side of a buckle ring. One end of a second strap is sewn onto the two ends of the first strap on the same side of the buckle ring. The second end of the second strap can be detachably fastened upon itself by a hook and loop system, such as Velcro®, through which to attach itself to the opposite side of the buckle ring.

U.S. Pat. No. 5,044,538, issued to Daniel M. Bader on Sep. 3, 1991, describes a carrying strap for luggage in which both ends include releasable fasteners, and where one end is disposed at an oblique angle. Each end is able to receive a portion of an article to be carried.

U.S. Pat. No. 4,982,885, issued to Sandra S. Severson et al. on Jan. 8, 1991, describes a device for coupling luggage using a plurality of releasably attachable snap buttons on straps to form multiple loops.

U.S. Pat. No. 4,863,083, issued to Carl W. Chen on Sep. 5, 1989, describes a carrying strap attachable to a belt. A loop is formed from the middle portion of a strap with releasable fasteners at its ends. The strap can be attached to a belt through the loop. The ends can be attached to one another to hold boots, skis and other objects.

U.S. Pat. No. 3,920,166 and U.S. Pat. No. 3,841,542 both issued to Philip C. Hogensen, Jr. on Nov. 18, 1975 and Oct. 15, 1974, respectively, describe a strap device convertible from a waist belt to a ski-carrier and vice versa. The strap includes a plurality of adjustment slides and buckles.

U.S. Pat. No. 3,275,205, issued to James W. Howd et al. on Sep. 27, 1966, describes a carrying strap that is doubled back on itself at its ends to form loops to function as either a handle or a cradle.

U.S. Pat. No. 2,884,173, issued to Edward J. Campbell et al. on Apr. 28, 1959, describes a double loop sling for carrying fire hoses. Two ends of a strap are attached to one side of a D-ring. A second strap with snap hooks at its ends is attached to the other side of the D-ring to form a figure eight. The second strap can be unhooked and wrapped around a fire hose before being reattached to the D-ring.

While these and other patents disclose carrying straps using hook and loop fasteners, the known prior art does not disclose or suggest the use of the particular strap configuration of the present invention. For example, none disclosed a threaded eyelet sewn within in the strap for passing through a portion of the fastener. In addition, prior straps were constructed for their utilitarian function with little regard towards their aesthetic quality. None of the above patent references, either alone or in combination with one another, is seen to describe the instant invention as claimed.

SUMMARY OF THE INVENTION

The object of the invention is to overcome the foregoing difficulties and shortcomings involved in carrying straps.

Another object of the invention is to provide an attractive carrying strap for toting coats and other articles.

Yet another object of the invention is to provide a portable carrying strap that can be converted into a clothing accessory.

A further object of the invention is to provide an adjustable carrying strap for toting coats and other articles.

To achieve the objects of the invention and in accordance with the purpose of the invention, as embodied and broadly described herein, a preferred embodiment of the invention comprises a band including a first side, a second side, a first end, a second end, and a slit formed in the band and between the first end and the second end; the first end further including attachment means for attaching the first end to the first side at a first location between the first end and the slit to form a noose capable of accepting a user's shoulder; the second end further including releasable fastener for fastening the second end to the first side, wherein the second end is drawn through the slit and fastened at a second location on the first side.

These and other objects of the present invention will become readily apparent upon further review of the following specification and drawings.

DETAILED DESCRIPTION OF THE PREFERRED EMBODIMENTS

Figure 1:
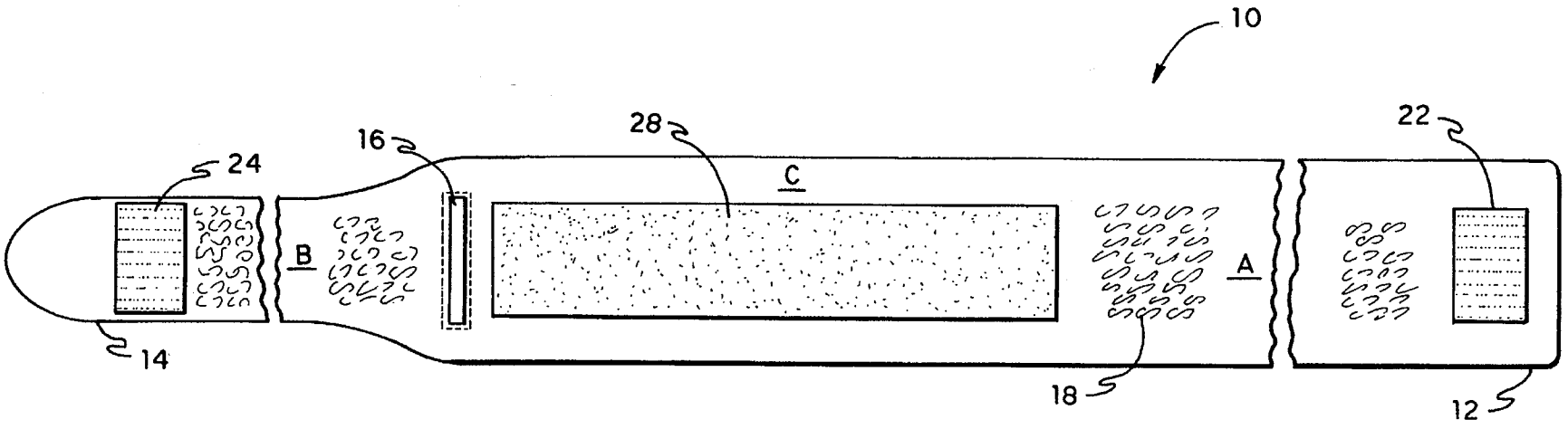
FIG. 1 is a top view of a preferred embodiment of the carrying strap with both ends unanchored according to the present invention.

Referring now to the accompanying drawings, a preferred embodiment of the present invention is illustrated. None of the disclosed embodiments should be construed as limiting the scope of the present invention. As shown in FIG. 1, continuous elongate strap 10 has fasteners 22 and 24 located at proximal and distal ends 12 and 14, respectively, of strap 10. Fasteners 22 and 24 are situated on the same side 18 of strap 10, and fasteners 22 and 24 are both of the same type. The center region C of strap 10 contains a corresponding fastener 28 for mating with fasteners 22 and 24. Preferably, fasteners 22, 24 and 28 comprise a hook and loop fastening system such as Velcro®. Fasteners 22 and 24 may constitute the hook element while fastener 28 forms the loop element, or vice versa.

A slit or eyelet 16 is formed in the strap between center fastener 28 and distal end 14, and should be positioned near or adjacent to center fastener 28. The area between eyelet 16 and distal end 14 delimits a region B. Eyelet 16 includes reinforced stitching along the edges to prevent fraying and to maintain the strength and integrity of strap 10. In addition, the distal end 14 of strap 10 may be tapered to allow for easier passage initially through eyelet 16. As will be described hereinbelow, distal end 14 may be drawn through eyelet 16 to form a noose for retaining a coat.

Figure 2:
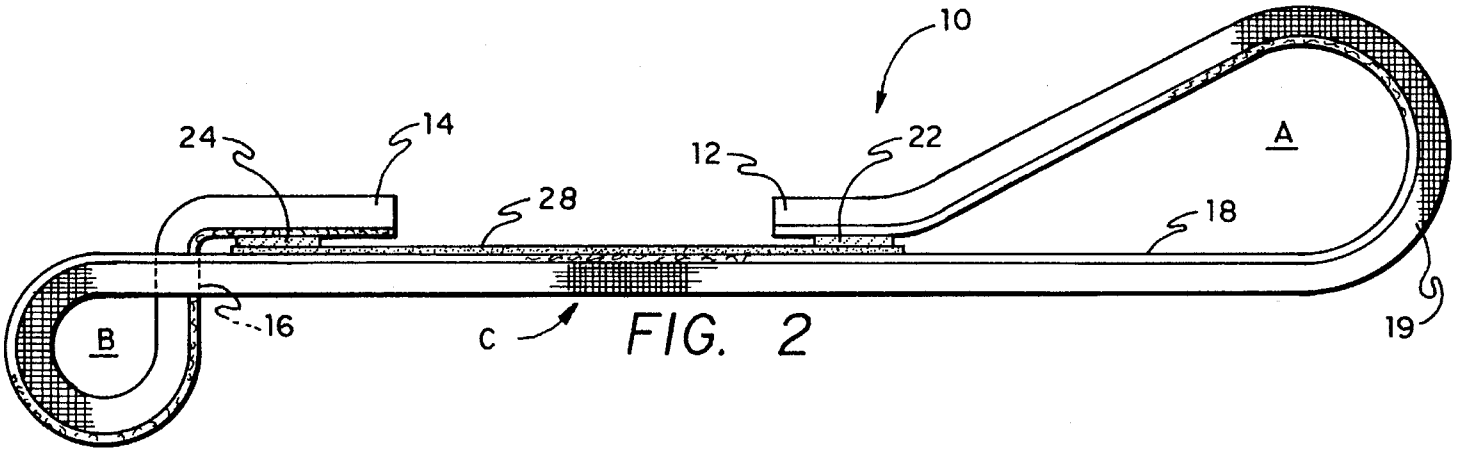
FIG. 2 is a side view of the carrying strap with both ends anchored in accordance with the present invention.

As shown in FIG. 2, distal end 14 is drawn through eyelet 16 from the opposite side 19. Fastener 24 on distal end 14 mates with center fastener 28 on side 18 of strap 10. The outside surface 19 of the closed in area of region B defines a circumference for accepting a coat or any similar article of clothing. By moving fastener 24 on distal end 14 up along center fastener 28 in region C towards proximal end 12, the circumference of region B of strap 10 is snugly wrapped around the coat.

Proximal end 12 is folded over to mate fastener 22 with center fastener 28 to form a shoulder noose defining a region A which may accept a user's shoulder, neck or the like. Shoulder region A may be adjusted by moving fastener 22 on proximal end 12 down along center fastener 28 in region C towards distal end 14. Both regions A and B are freely adjustable by repositioning fasteners 22 and 24 of ends 12 and 14, respectively, along center fastener 28. Alternatively, proximal end 12 may be stitched directly onto inner surface 18 in region C to provide for a more permanent shoulder strap configuration.

Strap 10 has two surface sides 18 and 19 which can be composed of different materials. For example, inner surface 18 may be composed of a threaded fabric such as cotton, and outer surface 19 may be composed of a heavier fabric such as wool. The soft wooly texture of surface 19 serves to protect the toted coat from frictional wear by strap 10.

Figure 3:
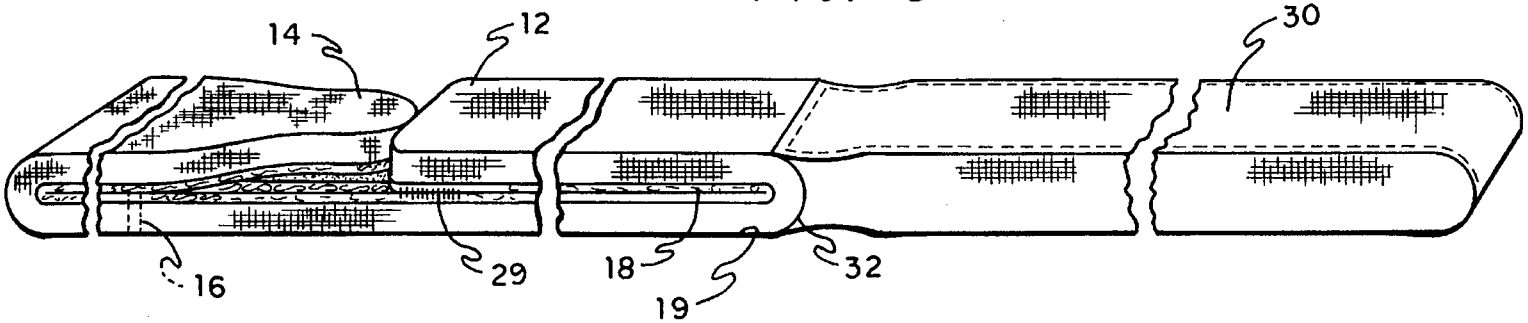
FIG. 3 is perspective view of another preferred embodiment of the carrying strap with both ends folded towards the center to form a scarf in accordance with the present invention.

As shown in FIG. 3, strap 10 may be convertible to form a clothing accessory such as a scarf. Proximal end 12 is folded over to mate fastener 22 with center fastener 28, and distal end 14 is folded over to mate at the opposite end of center fastener 28. In the embodiment shown in FIG. 3, proximal end 12 is sewn onto inner surface 18 by stitches 29 to form a more permanent attachment. However, distal end 14 may be fastened to inner surface 18 by the hook and loop fastening system described above, or by any other suitable fastening method. In this way, when strap 10 is folded on itself, only the outer surface 19 is exposed as the scarf. The wooly composition of surface 19 emulates the exterior of a scarf.

An optional extension attachment 30 for strap 10 is also shown in FIG. 3. Attachment 30 may be a tongue of knitted woolen fabric that is stitched onto a folded edge 32 of strap 10 in order to increase the length of the scarf without interfering with the carrying capability of the strap 10. When using strap 10 to carry a coat, attachment 30 merely hangs as a tail from the outside surface 19 of the shoulder strap. Instead of being convertible into a scarf, strap 10 could be modified to serve as a belt that may be tied at its ends. Alternatively, a buckle clasp may be added to one end of strap 10 to serve as a belt.

It is to be understood that the present invention is not limited to the exemplary embodiment described above. For example, neither the particular placement of the fasteners and attachments nor the length of the strap is limited to the above illustrated embodiments. It will be apparent to those skilled in the art that various modifications and variations are possible within the spirit and scope of the present invention. The present invention encompasses any and all embodiments within the scope of the following claims.

I claim:

1. A carrying strap for toting an object, comprising:

a continuous elongate strap having a first side, a second side, a first end having a first fastener, and a second end having a second fastener of the same type as said first fastener, said first fastener and said second fastener being located on said first side of said strap, said strap further having a slit through said first side and said second side, said slit being located between said first end and said second end;

a central region on said first side located between said first end and said slit, said central region having a corresponding fastener for mating with said first fastener and said second fastener;

said first fastener of said first end being adjustably attachable to a first section of said central region to form an adjustable shoulder noose; and said second fastener of said second end being drawn through said slit and adjustably attachable to a second section of said central region to define an adjustable circumference for holding the object.

2. A carrying strap according to claim 1, further comprising an extension attachment attached on said second side of said strap.

3. A carrying strap according to claim 1, wherein said first side is composed of a first fabric; and said second side is composed of a second fabric heavier than said first fabric.

4. A carrying strap according to claim 1, wherein said first side is composed of a threaded fabric, and said second side is composed of a woolen fabric.

5. A carrying strap according to claim 1, wherein said first fastener, said second fastener, and said corresponding fastener of said central region comprise a hook and loop fastening system.

6. A carrying strap for toting an object, comprising:

a continuous elongate strap having a first side, a second side, a first end, a second end having a fastener, and a slit through said first side and said second side, said slit being located between said first end and said second end;

a central region on said first side located adjacent to said slit, said central region having a corresponding fastener for mating with said fastener on said second end;

attachment means for permanently attaching said first end to said first side proximate to said central region to define a fixed shoulder noose;

said fastener on said second end being drawn through said slit and adjustably attachable to said corresponding fastener of said central region to define an adjustable loop at said second end for holding the object.

7. A carrying strap according to claim 6, wherein said said fastener on said second end and said said corresponding fastener of said central region are hook and loop fastening systems.

8. A carrying strap according to claim 6, wherein said attachment means comprise stitches.

9. A carrying strap according to claim 6, further comprising an extension attachment attached on said second side of said strap.

10. A carrying strap according to claim 6, wherein said first side is composed of a threaded fabric, and said second side is composed of a woolen fabric.

11. A carrying strap according to claim 6, wherein said first side is composed of a first fabric; and said second side is composed of a second fabric heavier than said first fabric.

12. A carrying strap according to claim 6, wherein said said corresponding fastener of said central region is located between said first end and said slit.

* * * * *